US006139280A

United States Patent [19]

Holt et al.

[11] Patent Number: 6,139,280

[45] Date of Patent: Oct. 31, 2000

[54] ELECTRIC SWITCH GAUGE FOR SCREW COMPRESSORS

[75] Inventors: James A. Holt, Edmond; William Dennis McMurtrie, Bartlesville, both of Okla.

[73] Assignee: Compressor Systems, Inc., Midland, Tex.

[21] Appl. No.: 09/010,303

[22] Filed: Jan. 21, 1998

[51] Int. Cl.[7] ..... F04B 49/00

[52] U.S. Cl. ..... 417/26; 418/201.2; 417/310; 417/280; 184/6.4; 184/6.16; 184/6.11; 184/6.1

[58] Field of Search ..... 418/201.2; 417/310, 417/26, 280; 184/6.4, 6.16, 6.11, 6.1

[56] References Cited

U.S. PATENT DOCUMENTS

| | | | |
|---|---|---|---|
| 1,654,081 | 12/1927 | Hoffman | 417/26 |
| 2,178,660 | 11/1939 | Carpenter | 417/26 |
| 2,225,854 | 12/1940 | Baker | 417/26 |
| 2,476,048 | 7/1949 | Lamberton | 417/26 |
| 2,600,855 | 6/1952 | Dale | 417/26 |
| 2,629,536 | 2/1953 | Baker | 417/26 |
| 2,704,631 | 3/1955 | Bancel | 417/26 |
| 2,789,755 | 4/1957 | Lamberton | 317/26 |
| 3,362,626 | 1/1968 | Schlirf | 417/26 |
| 3,472,215 | 10/1969 | Maxwell et al. | 417/26 |
| 4,080,110 | 3/1978 | Szymanski | 417/280 |
| 4,330,237 | 5/1982 | Battah | 417/26 |
| 4,336,001 | 6/1982 | Andrew et al. | 417/63 |
| 4,388,048 | 6/1983 | Shaw et al. | 417/310 |
| 4,394,113 | 7/1983 | Bammert | 418/98 |
| 4,678,406 | 7/1987 | Pillis et al. | 417/310 |
| 5,318,151 | 6/1994 | Hood et al. | 184/6.1 |
| 5,888,051 | 3/1999 | McLoughlin et al. | 417/26 |

FOREIGN PATENT DOCUMENTS

| | | | |
|---|---|---|---|
| 0029780 | 2/1987 | Japan | 417/26 |
| 0162782 | 7/1987 | Japan | 417/26 |
| 0162783 | 7/1987 | Japan | 417/26 |
| 535203 | 4/1941 | United Kingdom | 203/3 |

OTHER PUBLICATIONS

Frick, "Rotary Screw Compressors Models TDSH 163 through 355," 5 pages (Jul. 1996).

Murphy Mfr., "Dial Pressure Swichgage," 6 pages (Aug. 1986).

Murphy Mfr., "Differential Pressure for Filter Restriction," 2 pages (Feb. 1997).

Fluid Power Energy, Inc., "Thermostatic Control Valves," 2 pages (1997).

Fluid Power Energy, Inc., "Model Code System," 14 pages (1997).

Perry Energy Equipment Corp., "Filter Separators," 6 pages (1997).

Compressor Systems, Inc., "Engineered Rotary Screw Compression. . . ," (1997) 3 pages.

*Primary Examiner*—Thomas Denion
*Assistant Examiner*—Theresa Trieu
*Attorney, Agent, or Firm*—Wendy K. Buskop; Buskop Law Group

[57] ABSTRACT

A control apparatus, for measuring pressure in relation to a rotary screw compressor with capacity control means and a prime mover, including a pressure sensor to monitor the prime mover manifold pressure, and a series of relays which when tripped by the pressure sensor will engage a pressure mechanism to engage the capacity control means on the compressor. The pressure mechanism may be a hydraulic or a pneumatic pressure mechanism and the apparatus may further include a second pressure sensor to monitor the inlet gas pressure to the compressor and a third pressure sensor to monitor discharge pressure of the gas compressor.

9 Claims, 3 Drawing Sheets

CP
PD
V
T
P
2
4
6
8
10
12
13
14
16
18
20
22
24
25
26
28
30
32
34
36
38
40
42
44
46
48
50
52
54
56
58
60
62
64
66
68
70
78
82
84
86
88
90
92

ELECTRIC SWITCH GAUGE FOR SCREW COMPRESSORS

BACKGROUND OF THE INVENTION

1. Field of the Invention

The present invention generally relates to gas compressor systems and, more particularly, to an electric switch gauge control apparatus for a rotary screw compressor.

2. Description of Related Art

Helical lobe rotary compressors, or "screw compressors," are well-known in the refrigeration and natural gas processing industries. This type of gas compressor generally includes two cylindrical rotors mounted on separate shafts inside a hollow, double-barreled casing. The side walls of such compressor casings typically form two parallel, overlapping cylinders which house the rotors side-by-side, with their shafts parallel to the ground.

As the name implies, screw compressor rotors have helically extending lobes and grooves on their outer surfaces. During operation, the lobes on one rotor mesh with the corresponding grooves on the other rotor to form a series of chevron-shaped gaps between the rotors. These gaps form a continuous compression chamber that communicates with the compressor inlet opening, or "port," at one end of the casing and continuously reduces in volume as the rotors turn and compress the gas toward a discharge port at the opposite end of the casing. The compressor inlet is sometimes also referred to as the "suction" or "low pressure side" while the discharge is referred to as the "outlet" or "high pressure side."

Compressor operations are sometimes described in terms of a "pressure ratio" comparing the discharge pressure produced at the compressor outlet to the pressure of the gas supplied at the compressor inlet. Since the pressure and volume of a gaseous fluid are related by the its ratio of specific heats, pressure ratios are sometimes alternatively expressed in terms of a "volume ratio." Compressor operations are also described in terms of the volumetric flow rate of the gas flowing through the compressor referred to as "capacity." However, this latter term must be considered in the context in which it is used since it can also refer to the maximum output of a particular device.

U.S. Pat. No. 4,080,110 discloses a control system for a variable capacity compressor which senses changes in electrical current flow to a motor. A current transformer and a converter provide a first electrical signal which is proportional to compressor capacity for comparison against a second signal which proportional to a system condition. The first and second signals are compared by a proportioning relay to provide a third signal for adjusting a slide valve so as to regulate compressor capacity.

The rate at which energy is consumed by the compression process is generally referred to as the "load" on the compressor and is typically expressed in units of "horsepower." The load on a compressor is mainly a function of the volume ratio and capacity of the compressor. In broad terms, the load on a compressor changes in proportion to the product of the volume ratio and capacity at which the compressor is operated. Consequently, compressor horsepower increases when either the volume ratio or capacity of the compressor are increased. Similarly, compressor load decreases when the volume ratio or capacity are decreased.

The maximum anticipated compressor load is a significant factor for determining the power output required from the prime mover which rotates the compressor. An underpowered prime mover can be easily overloaded and damaged by the compressor. An overpowered prime mover unnecessarily increases the initial cost of the compression system and may overspeed the compressor. It is therefore important to match the power output of the prime mover to the anticipated load on the compressor and/or to control the load on the compressor so as not overload the available power output from the compressor.

It is particularly important to control the load on the compressor during start-up and shut-down when the compressor is likely to receive its highest and lowest loads, respectively. For example, most screw compressor manufacturers recommend gradually loading screw compressors during start-up in order to prevent overpowering the prime mover. A typical start-up procedure begins with blocking the inlet gas source and opening the suction and discharge lines to atmosphere (to minimize volume ratio). Then, the compressor is slowly rotated (to increase capacity) before bypassing the compressor discharge line to the suction line (to further increase capacity). Finally, the gas supply to the compressor inlet is opened while slowly opening the compressor discharge to the back pressure of the process (to increase volume ratio). Similar procedures are used to gradually unload the compressor during shut-down to prevent the prime mover from over-speeding. A variety of other start-up and shut-down procedures are also well known.

In addition to matching the compressor load to the power output of the prime mover, the volume ratio and capacity of the compressor must be individually matched to the requirements of the downstream process. For example, if the volume ratio of the compressor is too high, the compressor may discharge compressed gas at a higher pressure than is required by the downstream process. Alternatively, if the capacity of the compressor is too high, the compressor will draw down the pressure of the low pressure gas source. Both of these energy inefficient operating conditions cause an unnecessary increase to the load on the compressor and thus waste a portion of the power being supplied by the prime mover.

It is well known that the volume ratio and capacity of a screw compressors can be adjusted using a slide stop and slide valve arrangement. For example, U.S. Pat. No. 4,678,406 discloses a typical configuration where the compressor operates at full capacity when the slide valve and slide stop are in contact with each other as shown in FIGS. 1–3 of the patent. In that patent, the position of the two slides together controls the volume (and pressure) ratio of the compressor and their position is adjusted in response to a signal from a pressure sensor connected to the discharge line from the compressor. When the discharge pressure drops below a set value, the slides move toward the discharge end of the compressor in order to increase the volume ratio of the compressor and prevent under compression of the gas. When the discharge pressures rises above a different value, the slides move in the other direction to decrease the volume ratio and prevent over-compression of the gas. FIG. 4 of U.S. Pat. No. 4,678,406 illustrates a slightly different configuration for operating the compressor at less than full capacity where the slide valve and stop are separated by a gap. In FIG. 4 of that patent, the position of the slide stop, and hence capacity, are adjusted in response to a signal from a pressure sensor in the suction line.

As noted above, the load on a compressor is mainly a function of the volume ratio times the capacity of the compressor. Although the arrangement discussed with respect to above can change the compressor load by individually adjusting the volume ratio and/or the capacity, it cannot sense the actual compressor load because there is no way to multiply these two variables. Thus, that arrangement cannot be used to control the load on the compressor.

One solution to this problem is to provide some type of additional control means for calculating compressor load based upon volume ratio, capacity, and/or other process variables. For example, U.S. Pat. No. 4,336,001 discloses a solid state compressor control system which indirectly calculates compressor load based on the position of a slide valve. Since the position of the slide valve indicates mostly the volume ratio of the compressor, the control system must make an assumption about capacity in order to calculate load. The safest assumption to use is that the compressor is operating at maximum capacity so that the actual load on the compressor is always maintained at less than the calculated load.

Although this assumption results in a margin of safety when the compressor is operated at less than full capacity, it also limits the volume ratio at which the compressor will operate at less than full capacity. Consequently, it does not allow the compressor load to be matched to the load capacity of the prime mover. In addition, such computer control systems are often complex, and therefore, difficult and expensive to implement, operate, and maintain.

SUMMARY OF THE INVENTION

The invention disclosed below addresses these and other drawbacks associated with conventional compressor systems by providing a control apparatus for measuring pressure in relation to a rotary screw compressor with capacity control means and a prime mover including a first pressure sensor to monitor the prime mover manifold pressure, and a series of relays which, when tripped by the pressure sensor, will engage a pressure mechanism to engage the capacity control means on the compressor. The pressure mechanism is preferably selected from the group consisting of a hydraulic and a pneumatic pressure mechanism. The apparatus may further include a second pressure sensor to monitor the inlet gas pressure to the compressor and a third pressure sensor to monitor discharge pressure of the gas compressor.

The pressure sensor may have at least two signals each capable of providing a signal to a control means to engage a pressure mechanism to move the capacity control means on the compressor. The pressure mechanism is preferably selected from the group consisting of hydraulic and pneumatic pressure mechanisms and the capacity control means preferably consists of a moveable slide valve run by a hydraulic actuator or controlled by a solenoid valve. The capacity control means may be selected from the group consisting of a poppet valve, a slide valve, and a herring bone unloader. The prime mover is a power source that may be selected from the group consisting of natural gas engines, steam engines, diesel engines, electric motors, gas and steam turbines, windmills, or other power sources.

In a preferred embodiment, the control apparatus includes as the series of relays, two sets of contact points normally in the open position and capable of closing magnetically when a signal is received from a sensor, a solenoid valve to move the capacity control means, a timer for shutting off the supply of electrical power to the control apparatus, and a power supply. More particularly, the preferred embodiment includes a two pole double throw switch connected to each of the sensors, and two sets of contact points normally in the open position which are capable of closing magnetically when a signal is received from a sensor connected via the two pole double throw switch; The apparatus may further include a timer for shutting off the supply of electrical power to the control apparatus. The power supply for the control system may be selected from the group including a standard automotive battery, a deep cycle battery, solar power, or the commercial electrical grid.

In another embodiment, the invention includes a control apparatus for measuring amperage draw of a prime mover of a rotary screw compressor with capacity control means including a first amperage sensor to monitor amperage draw on the prime mover, and a series of relays which, when tripped by the sensor will engage a pressure mechanism to engage the capacity control means on the compressor.

DESCRIPTION OF THE PREFERRED EMBODIMENTS

Figure 1:
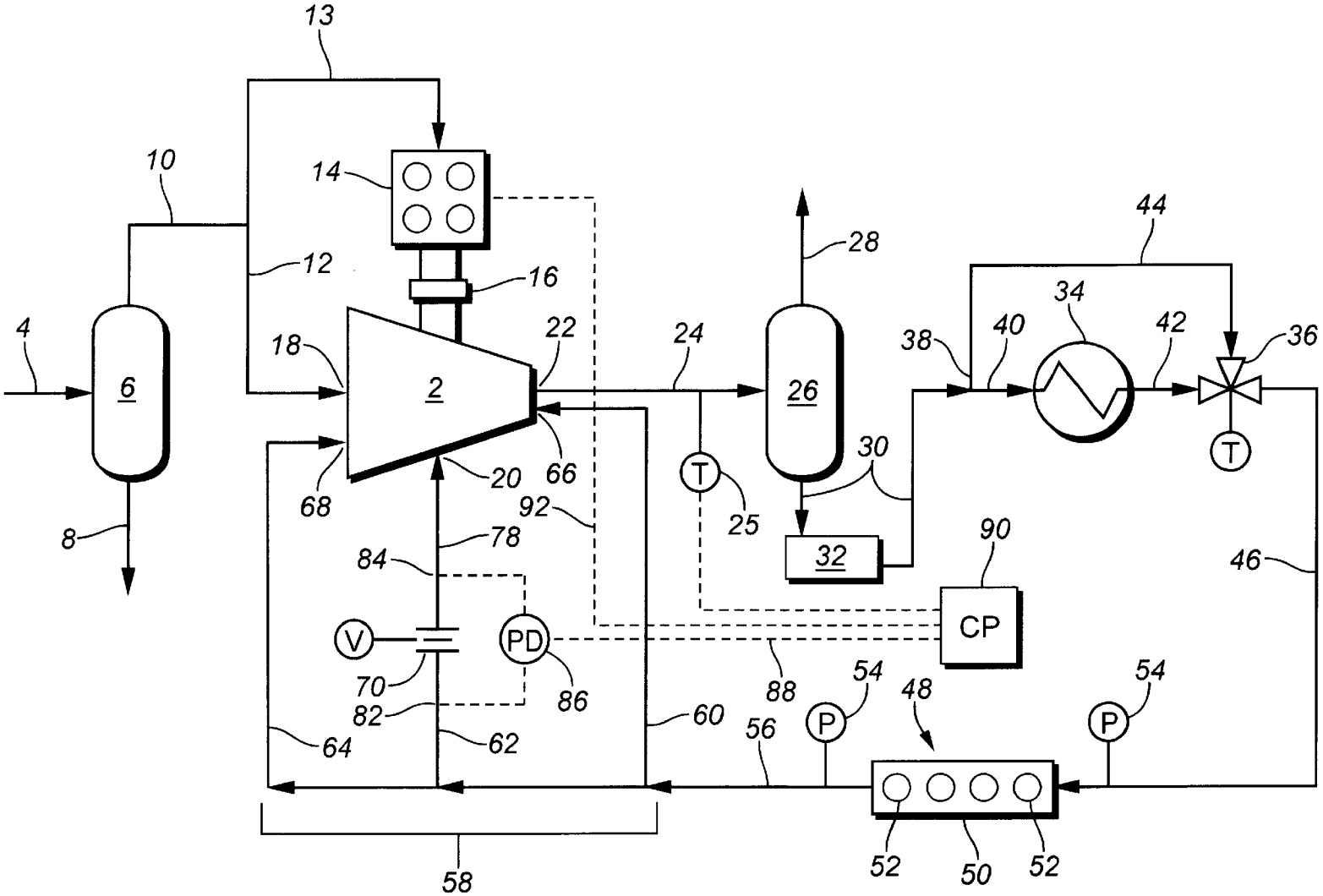
FIG. 1 is a schematic process flow diagram of a gas compression process and compressor system.

FIG. 1 shows a schematic diagram of a gas compression process and compressor system including a rotary screw gas compressor 2. The compressor 2 is preferably a Model TDSH (163 through 355) rotary screw compressor available from Frick Company in Waynesboro, Pa. However, a variety of other oil flooded and oil free screw compressors, and other types of compressors, may also be used.

In FIG. 1, a raw gas feed stream 4 from a natural gas well (not shown), or other gaseous fluid source, is supplied to a scrubber 6 for separating fluids and any entrained solids from the raw gas stream 4. The scrubber 6 may be any suitable two- or three-phase separator which discharges a liquid stream 8 to a disposal reservoir (not shown) and an essentially dry low pressure gas stream 10 to the compressor 2. The gas may also be dried using other well-known conventional processes. The dry low pressure gas stream 10 is then supplied to an inlet stream 12 and may also be supplied to a fuel stream 13 for fueling a prime mover 14. Although the prime mover 14 shown in FIG. 1 is a natural gas engine, a variety of other power plants, such as diesel engines or electric motors, may also be used to drive the compressor 2 through a coupling 16.

The compressor 2 receives low pressure gas through an inlet port 18. A suitable lubricant is supplied to the inside of the casing of the compressor 2 through a main oil injection port 20 where it is mixed with the gas to form a low pressure gas/oil mixture. The low pressure gas/oil mixture is then compressed and discharged from the compressor 2 through a discharge port 22 into a high pressure gas/oil mixture stream 24. A separator 26 receives the high pressure gas/oil mixture stream 24 and separates the gas from the oil and/or other lubricant in the mixture stream 24. The discharge temperature of the gas/oil mixture from compressor 2 may be monitored by a temperature sensor 25.

The separator 26 discharges a high pressure gas stream 28 for further processing and/or distribution to customers. In addition, the separator also discharges a high temperature oil stream 30 to a lube-oil cooler 34, preferably through a lube-oil collection reservoir 32 via one- to three- inch diameter stainless steel tubing, or other suitable conduit. The lube-oil collection reservoir may also be arranged in the bottom of the separator. The lube-oil cooler 34 preferably cools the high temperature lube-oil stream 30 from a temperature of 190° F. to 220° F., or preferably 195° F. to 215° F., to a temperature in the range of 120° F. to 200° F., and preferably in the range of 140° F. to 180° F., or nearly 170° F. for an oil flow rate of about 10–175 gallons per minute.

Typical coolers that may be used with the disclosed compressor system include shell and tube coolers such as ITT Standard Model No. SX 2000 and distributor Thermal Engineering Company's (of Tulsa, Okla.) Model Nos. 05060, 05072, and others. Plate and frame coolers, such as Alfa Laval MGFG Models (with 24 plates) and M10MFG Models (with 24 or 38 plates) may also be used, as may forced air "fin-fan" coolers such as Model L156S available from Cooler Service Co., Inc. of Tulsa, Okla. A variety of other heat exchangers and other cooling means are also suitable for use with the compressor system shown.

In a preferred embodiment, the temperature of the lubricant leaving the lube-oil cooler 34 is controlled using a by-pass stream 44 and a thermostat 36 which is preferably a three-way thermostatic valve such as Model No. 2010 available from Fluid Power Engineering Inc. of Waukesha, Wis. Although the manufacturer's specifications for this particular type of valve show it as having one inlet port and two outlet ports, it may nonetheless be used with the present system by using one of the valve's outlet ports as an inlet port. Other lube-oil temperature control systems besides thermostats and/or thermostatic control valve arrangements may also be used.

As shown in FIG. 1, the high temperature oil stream 30 is split into two branches (or "flows") by a two-way splitter 38 prior to reaching the thermostat 36. The splitter 38 is preferably formed from T-shaped stainless steel tubing; however, other "T" fittings may also be used. The first branch 40 of high temperature lube-oil stream 30 goes directly into the cooler 34 where it is discharged through a cooled lube-oil branch 42 into the thermostat 36. The second, or "by-pass," branch of high temperature lube-oil stream 30 bypasses the cooler 34 and goes directly into the thermostat 36 where it may be mixed with lubricant from the cooled lube-oil branch 42 to control the temperature of a mixed (first and second branch) cooled lube-oil stream 46 leaving the thermostat 36. By controlling the amount of lube-oil from each of the first and second branches 42 and 44 flowing through the thermostat 36, the thermostat can control the temperature of the cooled lube-oil stream 46 leaving the thermostat.

The cooled lube-oil stream 46 then flows through a filter assembly 48 to create a filtered stream 56. The filter assembly 48 includes a housing 50 for supporting a plurality of filters 52. A preferred filter housing 50 is available from Beeline of Odessa, Tex., for supporting four filters 52, such as Model Nos. B99, B99 MPG, and B99HPG available from Baldwin Filters of Kearney, Nebr. However, a variety of other filters and filter housings may also be used. Pressure indicating sensors 54 may also be provided at the inlet an outlet of the filter housing for determining the pressure drop across the filters 52 and providing an indication as to when the filters need to be changed. The filter assembly 48 may also be arranged in other parts of the process, such as between the reservoir 32 and two-way splitter 38.

Downstream of the filter assembly 48, the filtered lubricant stream 56 flows into a three-way splitter 58 forming a discharge bearing and seal branch 60, an orifice branch 62, and a suction bearing branch 64. The discharge bearing branch 60 provides filtered and cooled lube-oil to the seals and discharge bearings of the compressor 2 through a lubrication port 66 while the inlet bearing branch 64 provides filtered and cooled lube-oil to the inlet bearings, and possibly a balance piston, through lubrication port 68.

Figure 2:
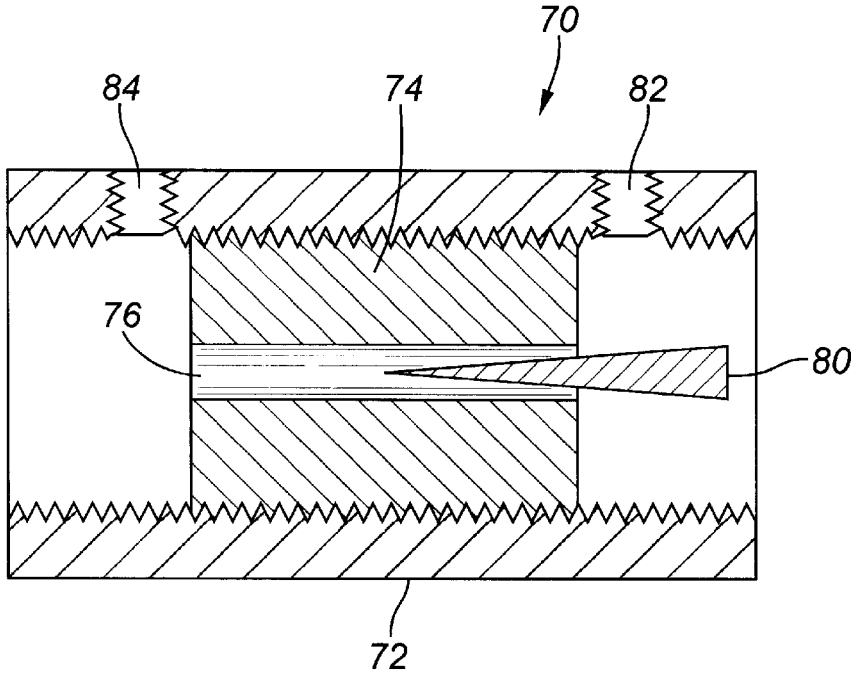
FIG. 2 is a cross-sectional illustration of a variable orifice assembly for use with the gas compressor and process shown in FIG. 1.

The orifice branch 62 of the filtered and cooled lube-oil stream 56 supplies filtered and cooled lubricant to an external orifice assembly 70. As shown in FIG. 2, the orifice assembly 70 preferably includes an internally threaded orifice housing 72 for receiving an externally threaded (preferably steel) tube 74 having a bore 76 through which cooled and filtered lube-oil from the orifice branch 64 can flow through the injection oil branch 78 (see FIG. 1) to the main oil injection port 20 on compressor 2 (also shown in FIG. 1). In the preferred embodiment shown in FIG. 2, the orifice assembly 70 may further be provided with a moveable plug 80, or other flow control means, for manipulating the flow rate of lube-oil through the bore 76. A variety of conventional choke valves are suitable for providing the throttling effect of moveable plug 80.

The orifice assembly 70 may also include two pressure sensing ports 82 and 84 connected to a differential pressure sensor 86 such as a Model No. 25-DP-LTP-150 differential switch pressure gauge available from Frank W. Murphy Manufacturer of Tulsa, Okla. When the differential pressure sensor 86 senses a pressure difference across the orifice (and therefore a flow rate through the orifice assembly) which is too low, it provides a signal on a control line 88 to a control panel 90 which then sends another control signal over control line 92 to the prime mover 14 that automatically shuts down the prime mover and/or the compressor 2. The set point of the differential switch pressure gauge for this system will typically range from 20–300 psid, or preferably 20–100 psid, so that the lube-oil flow through the orifice assembly ranges from 5–250 gallons per minute ("gpm"), or preferably 10–175 gpm. However, a variety of other set points and flow rates may also be used. Alternatively, the low main oil injection flow signal from the differential pressure sensor 86 may simply produce an alarm or may be transmitted directly to the prime mover 14 and/or the compressor 12 without going through the control panel 90.

The prime mover 14 and/or compressor 2 may also be shut down based upon a signal from temperature sensor 25 which may or may not travel through the control panel 90. Similarly, the control panel 90 may be linked to the pressure sensors 54 to provide an indication when the filters 52 need to be changed.

The compressor system discussed above has been found to require 20–35 psid less differential pressure between the compressor inlet port 18 and the discharge port 22 than conventional screw compressors systems without lube-oil circulation pumps. Consequently, the disclosed compressor system provides greater operational flexibility for a lower initial cost than similar conventional compressor systems.

Figure 3:
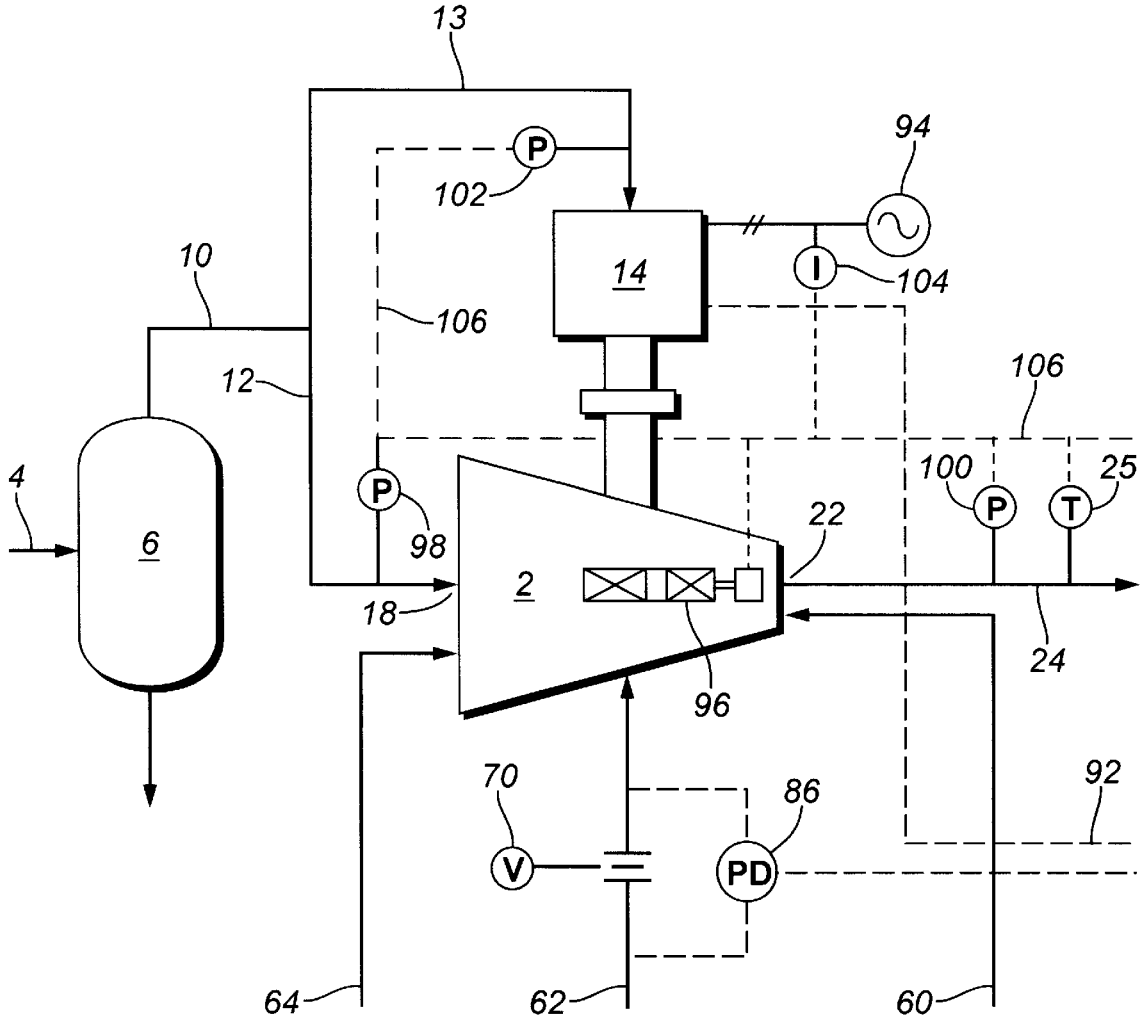
FIG. 3 is an enlarged portion of FIG. 1 with a schematic illustration of a throttling control scheme.

FIG. 3 is an enlarged portion of FIG. 1 which has be augmented to include a schematic illustration of a control system. In FIG. 3, the prime mover 14 may be fueled by a fuel gas stream 13, as in the case of a gas engine or gas turbine, or an electrical power source 94, in the case of an electric motor. Other prime movers and power sources may also be used, such as steam engines and turbines, gasoline and diesel engines, windmills, waterwheels, or others.

A capacity control device 96 (not shown in FIG. 1) is arranged in the compressor 2. Although the capacity control device 96 is illustrated as a slide valve and actuator, a variety of devices for controlling the capacity and/or volume ration for the compressor 2 may also be used including manually operated valves of various types, variable orifice assemblies, poppet valves, slide valves, and herring bone unloaders. For example, a preferred configuration available from Frick Company of Waynesboro, Pa. includes a Variable Volume Ratio moveable slide valve stop arrangement on the compressor discharge for allowing the compressor to be adjusted from 10–100% full capacity. A variety of techniques for actuating the slide valve and/or slide stop may be used such as pneumatic and hydraulic pressure actuators, servomotors, solenoid valves.

FIG. 3 also shows pressure indicating and transmitting sensors 98, 100, and 102 arranged near the compressor intake port 18, discharge port 22, and intake manifold of the prime mover 14, respectively, for sensing and monitoring the various pressures at these points in the system. The pressure transmitting sensors 98–102 are preferably switch gauges which can determine, and possibly indicate, the status of a process variable and throw a switch when that process variable reaches a set value. Preferred switch gauges are equivalent to Model No. 45 PEBP available from Frank W. Murphy Manufacturers of Tulsa, Okla. Murphy Model Nos. 45PE and 45PEF, and others, may also be used.

In general, the intake manifold pressure of an engine will increase as the throttle is opened to allow the engine to consume more fuel and produce more horsepower. In a preferred embodiment, the intake manifold of a natural gas engine for driving the compressor 2 will draw about 18 in. Hg of vacuum when the compressor is lightly loaded and a weaker vacuum when it is more heavily loaded. Consequently, the pressure sensor 102 is preferably a vacuum pressure sensor that will sense less vacuum as the load on compressor 2 is increased.

In order to prevent an engine prime mover 14 from overloading and breaking down, the pressure sensor 102 preferably sends a control signal to the capacity control device 96 whenever the vacuum pressure measured by sensor 102 increases in magnitude, such as around 5 in Hg. for a naturally aspirated engine. (Higher positive pressures may be used as the set point for turbo-charged engines.) That control signal will signal the actuator for capacity control device 96 to cause the device to reduce the capacity of the compressor 2, and thus unload the compressor, the load on the prime mover gets too high.

Alternatively, or in addition to the control signal produced by pressure sensor 102, pressure sensor 98 may be arranged to transmit an unload signal to the capacity control device 96 when the suction pressure gets too low, as can occur when the demand for compressed gas rises. The temperature sensor 25 may also be used for sending a signal to the capacity control device for decreasing the capacity when the discharge temperature of the compressor 2 gets too high. In a preferred embodiment, a switch is provided for switching the capacity control from sensor 98 to sensor 102.

Alternatively, or in addition to the temperature and/or pressure sensors 98 and 102, the compressor system may include a pressure sensor 100 for transmitting a signal to the capacity control device for unloading the compressor when the discharge pressure gets too high, as might occur when the discharge stream is blocked by a pig.

If the compressor 2 is powered by an electric motor, a current or power sensor 104 may be provided for sensing the current drawn, power used, and/or other electrical variables for an electric prime mover 14 and providing a control signal to the throttling device 96 for loading or unloading the compressor.

The control signals provided by transmitting sensors 98–102 may be hydraulic, pneumatic, electric, or of another form. Various power supplies may be used to produce the control signals including a standard automotive battery, a deep cycle battery, solar power, or the commercial electrical grid. In order to simplify the drawing, a single control line 106 has been shown for all of the sensors. However, in practice, each sensor will have its own independent transmitter and independent communication line. The signals on those control lies may travel directly to the capacity control device 96 as shown conceptually in FIG. 3, or they may first travel through a control panel and/or process controller as with the sensors shown in FIG. 1.

Since it is usually preferable to change the compressor capacity very slowly, the control signals from the sensors 98–102 may be placed on a timer (not shown), or through an integral controller, that prevents actuation of the capacity control device 96 until a control signal has been sent from one of the sensors for a certain continuous period of time. A timer or integral controller is particularly useful for quick actuators like servomotors or solenoids. The timer may also be used to shut-off the power for the control lines 106 in order to reset (or set) the sensors after a control action has taken place and during start-up or shut-down. Other types of controllers, such as proportional, integral, and computerized controllers, may also be employed.

In a preferred embodiment, the sensors 98–102 each include a transmitter having plurality of relays. The transmitters preferably include two single pole double throw (preferably snap-acting) switches, a double pole double throw switch, or a two pole double throw switch. In addition, the relays preferably include two sets of normally open contact points which are closed when a signal is received from a sensor transmitter connected via the two pole double throw switch. The relays, when tripped by the sensor, will drive the actuator to cause the capacity control device 96 to control the flow through the compressor.

Figure 4:
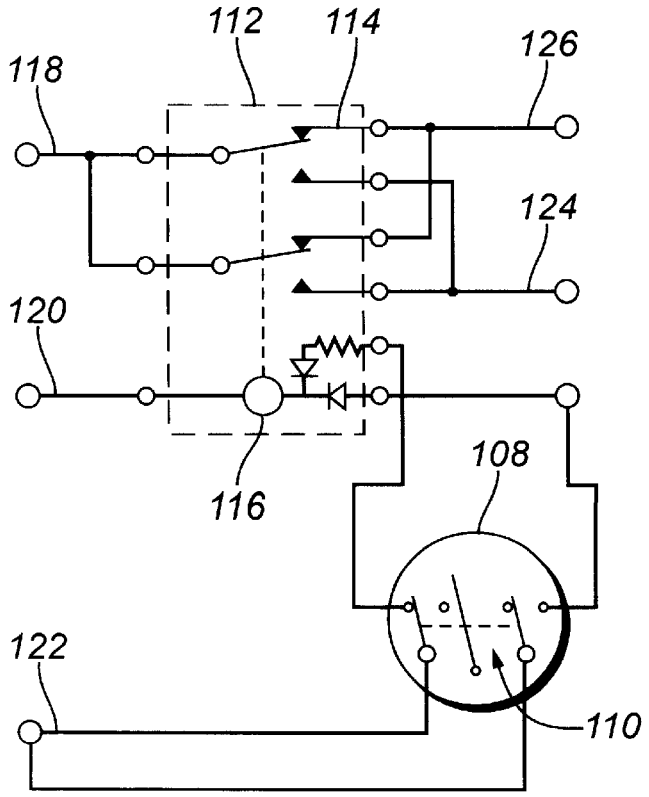
FIG. 4 is a schematic electrical diagram of a switch gauge for use with the control system shown in FIG. 3.

FIG. 4 is a schematic electrical diagram for one embodiment of a switch gauge for use with the control system shown in FIG. 3. The illustrated switch gauge includes an indicator 108 having a double pole single throw switch 110, and a relay 112 having a double pole double throw switch 114 with two sets of contacts driven by magnetic solenoid actuator 116 connected to the switch 110. In a typical application, the switch gauge includes a common connection 118, a negative or neutral connection 120, a positive or line connection 122, a set connection 124, and a reset connection 126. In this way, a low voltage control signal transmitted through the line and neutral connections controls power transmission through the relay 112.

The control system disclosed above offers a simple and inexpensive means for automatically controlling a screw compressor based upon compressor inlet pressure, discharge pressure, and prime mover load. It can be easily retrofitted on a manually controlled compressor in order to reduce the labor required for loading and unloading the compressor during start up, shut down, upsets and other capacity changing process events.

While the compressor system, control system, and processes described above have been discussed with respect to certain drawings, vendors, products, and preferred configurations, this description is merely illustrative of some of the various useful forms in which the invention might be reduced to practice by one of ordinary skill in the art. The scope of the actual invention, on the other hand, is defined by the subject matter of the following claims.

What is claimed is:

1. A control apparatus for measuring pressure in relation to a rotary screw compressor with capacity control means and a prime mover comprising:

a pressure sensor to monitor the prime mover manifold pressure; and a series of relays which when tripled by the pressure sensor will engage a pressure mechanism to engage the capacity control means on the compressor, wherein the pressure mechanism is selected from the group consisting of a hydraulic and a pneumatic pressure mechanism; and wherein the pressure sensor has at least two signals each capable of providing a signal to a control means to engage a pressure mechanism to move the capacity control means on the compressor and wherein the pressure mechanism is selected from the group consisting of a hydraulic and a pneumatic pressure mechanism.

2. A control apparatus for measuring pressure in relation to a rotary screw compressor with capacity control means and a prime mover comprising:

a pressure sensor to monitor the prime mover manifold pressure; and a series of relays which when tripped by the pressure sensor will engage a pressure mechanism to engage the capacity control means on the compressor, wherein the pressure mechanism is selected from the group consisting of a hydraulic and a pneumatic pressure mechanism; and as the series of relays, two sets of contact points normally in the open position and capable of closing magnetically when a signal is received from a sensor;

a solenoid valve to move the capacity control means;

a timer for shutting off the supply of electrical power to the control apparatus; and a power supply.

3. The control apparatus of claim 2, wherein the power supply is selected from the group comprising: a standard automotive battery, a deep cycle battery, solar power, or the commercial electrical grid.

4. A control apparatus for measuring pressure in relation to a rotary screw compressor with capacity control means and a prime mover comprising:

a pressure sensor to monitor the prime mover manifold pressure; and a series of relays which when tripped by the pressure sensor will engage a pressure mechanism to engage the capacity control means on the compressor, wherein the pressure mechanism is selected from the group consisting of a hydraulic and a pneumatic pressure mechanism; and a second pressure sensor to monitor the inlet gas pressure to the compressor;

a two pole double throw switch connected to each of said sensors;

as the series of relays, two sets of contact points normally in the open position and capable of closing magnetically when a signal is received from a sensor connected via the two pole double throw switch;

a solenoid valve to move the capacity control means;

a timer for shutting off the supply of electrical power to the control apparatus; and a power supply.

5. The control apparatus of claim 4, wherein the power supply is selected from the group comprising: a standard automotive battery, a deep cycle battery, solar power, or the commercial electrical grid.

6. A control apparatus for measuring pressure in relation to a rotary screw compressor with capacity control means and a prime mover comprising:

a first pressure sensor to monitor the prime mover manifold pressure; and a series of relays which when tripped by the pressure sensor will engage a pressure mechanism to engage the capacity control means on the compressor, wherein the pressure mechanism is selected from the group consisting of a hydraulic and a pneumatic pressure mechanism;

a second pressure sensor to monitor the inlet gas pressure to the compressor; and a third pressure sensor to monitor discharge pressure of the gas compressor.

7. A control apparatus for measuring pressure in relation to a rotary screw compressor with capacity control means and a prime mover comprising:

a first pressure sensor to monitor the prime mover manifold pressure; and a series of relays which when tripped by the pressure sensor will engage a pressure mechanism to engage the capacity control means on the compressor, wherein the pressure mechanism is selected from the group consisting of a hydraulic and a pneumatic pressure mechanism;

wherein said capacity control means is selected from the group consisting of: a moveable slide valve run by a hydraulic actuator controlled by a solenoid valve; a poppet valve, and a herring bone unloader; and wherein said prime mover is selected from the group comprising: a natural gas engine, a steam engine, a diesel engine, an electric motor, a gas turbine, a windmill or other power source.

8. The control apparatus of claim 7, further comprising a second pressure sensor to monitor the inlet gas pressure to the compressor.

9. The control apparatus of claim 7, further comprising a third pressure sensor to monitor discharge pressure of the gas compressor.

* * * * *